United States Patent [19]

Mc Namara

[11] Patent Number: 4,852,599

[45] Date of Patent: Aug. 1, 1989

[54] PORTABLE SHELTER FRAME STRUCTURE

[75] Inventor: Thomas Mc Namara, Port Jefferson, N.Y.

[73] Assignee: Random Wheels, Inc., Port Jefferson, N.Y.

[21] Appl. No.: 184,812

[22] Filed: Apr. 22, 1988

[51] Int. Cl.[4] ..... E04B 1/32

[52] U.S. Cl. ..... 135/102; 135/106; 52/86

[58] Field of Search ..... 135/102, 106; 52/86

[56] References Cited

U.S. PATENT DOCUMENTS

| | | | |
|---|---|---|---|
| 657,369 | 9/1900 | Strauss | 135/DIG. 1 X |
| 2,946,337 | 7/1960 | Wolshim | 135/102 X |
| 3,042,053 | 7/1962 | Gabriel | 135/DIG. 1 X |
| 3,084,703 | 4/1963 | Lefebvre et al. | 135/106 X |
| 3,465,765 | 9/1969 | Dietz | 135/102 |
| 3,633,326 | 1/1972 | McKnight | 52/86 |
| 3,765,134 | 10/1973 | Gilchrist | 52/86 X |
| 3,766,691 | 10/1973 | Ray | 52/86 X |
| 3,820,553 | 6/1974 | Huddle | 135/DIG. 1 X |
| 3,855,643 | 12/1974 | Sanford et al. | 52/86 X |
| 4,077,158 | 3/1978 | England | 52/86 X |
| 4,091,584 | 5/1978 | Brown | 52/86 X |
| 4,096,874 | 6/1978 | Weatherly | 135/102 |
| 4,121,604 | 10/1978 | Rain | 52/63 X |
| 4,536,997 | 8/1985 | Heescher | 52/86 |
| 4,605,029 | 8/1986 | Russell | 135/106 X |

FOREIGN PATENT DOCUMENTS

| | | | |
|---|---|---|---|
| 1159914 | 7/1958 | France | 135/106 |

*Primary Examiner*—David A. Scherbel
*Assistant Examiner*—Lan Mai
*Attorney, Agent, or Firm*—Bauer & Schaffer

[57] ABSTRACT

A frame structure formed of a plurality of parallelly disposed rafter bars having axially connected thereto, a plurality of bow members forming the rear wall. The edges of said rafter bars are connected to a ridge bar and supported above ground level by uprights connected thereto in the vicinity of said ridge bar and the ends of said bow members being set in base plates on the ground, and a covering shaped to fit over said frame structure. Various cross bars and supports may be provided.

11 Claims, 2 Drawing Sheets

Fig. 1
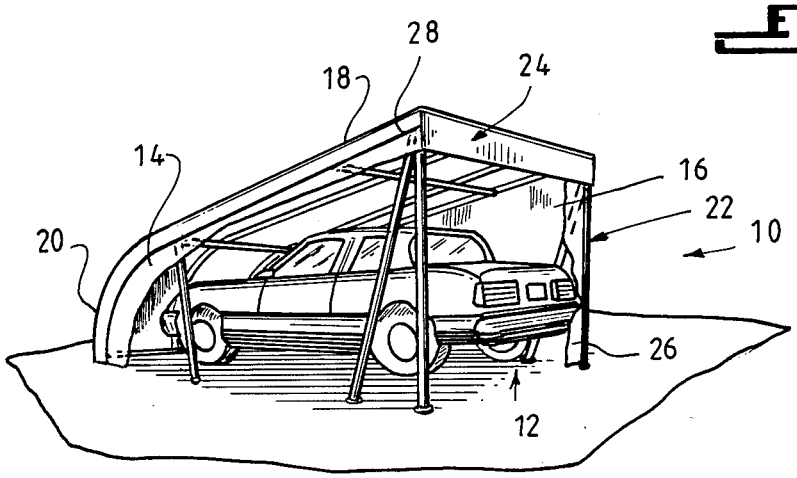
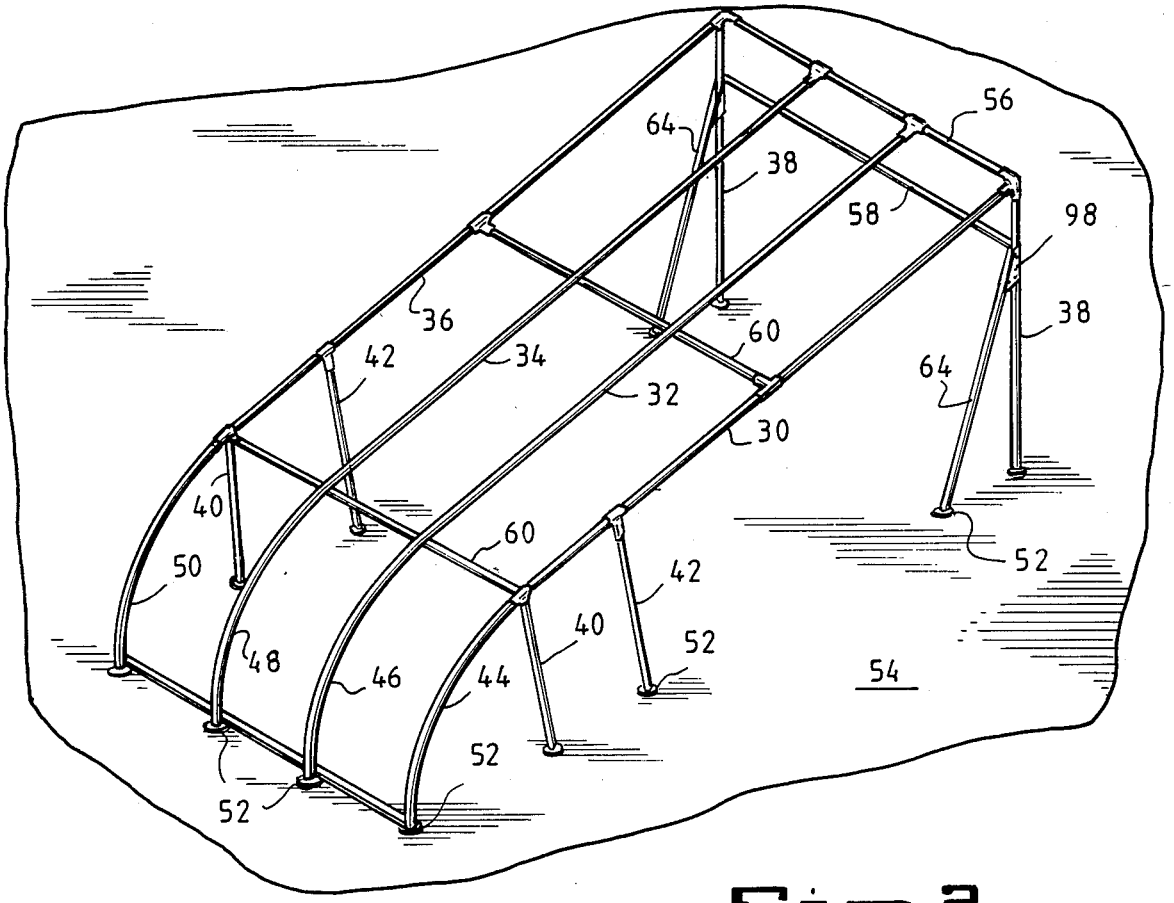
Fig. 2

PORTABLE SHELTER FRAME STRUCTURE

The present invention relates to a shelter frame structure. More particularly it relates to a portable shelter frame construction of lightweight but having good strength and stability for use as a garage or storage facility for vehicles.

BACKGROUND OF THE INVENTION

A wide variety of portable shelter frame constructions are known. Expositions of such constructions are contained in U.S. Pat. Nos. 3,424,178; 3,270,755; 2,922,653; 2,840,400 and 2,835,262. Such types of construction are employed to shelter automobiles, boats, aircraft and the like, or even as warehouses for equipment and other items. While most of the known constructions are useful for their claimed functions, many exhibit drawbacks with respect to their complexity, stability and strength. There exists, therefore, a need for a portable shelter frame structure which is simple, has good stability and strength. The present invention fulfills such a need.

BRIEF STATEMENT OF THE INVENTION

In accordance with the present invention, there is provided a portable shelter frame construction comprising a roof including a plurality of parallel disposed rafter bars having axially connected thereto, a plurality of bow members, the edges of the rafter bars being connected to a ridge bar and being supported above ground level by a pair of upright bars connected thereto in the vicinity of the ridge bar, the upright bars and the ends of the bow members being set in base plates on the ground, and a covering shaped to fit over the frame structure.

DRAWINGS

In order to describe the inventive portable shelter frame construction more fully, reference is directed to the accompanying drawings which are to be taken in conjunction with the following detailed description thereof and in which drawings:

FIG. 1 is a perspective view from the front and of a shelter frame construction according to the present invention with the covering disposed on the assembled bar elements;

FIG. 2 is a view in perspective of the portable shelter frame construction with the covering removed showing the various elements in assembled relationship with the covering removed;

DETAILED DESCRIPTION OF THE PREFERRED EMBODIMENTS

Figure 4:
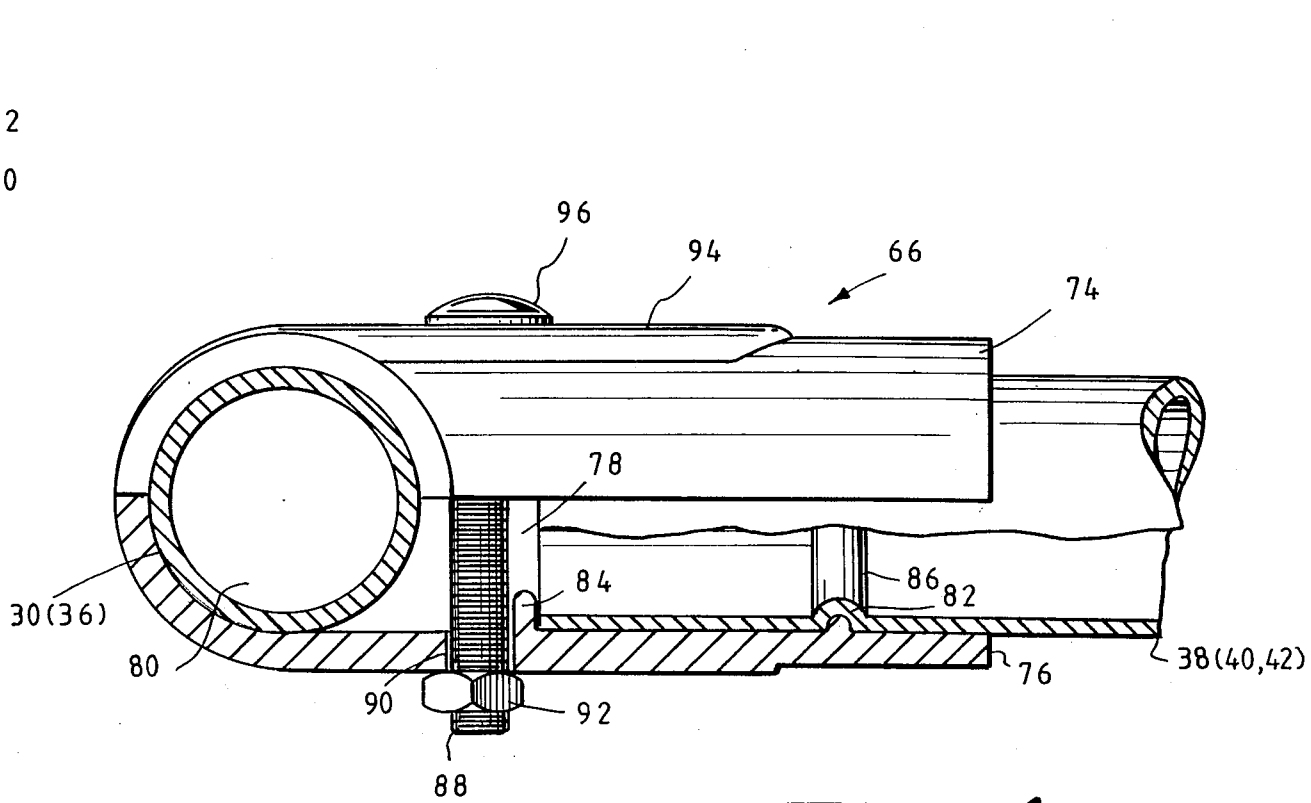
FIG. 4 is a plan view of a two part bracket for connecting the rafter and vertical upright bars, partially broken away to show its construction.

Referring now more particularly to FIG. 1, there is shown a portable shelter frame formed in accordance with the present invention, generally depicted by the numeral 10. The shelter 10 is formed to have an open front 12, left and right front walls 14 and 16 respectively and a roof extending from the front 12 to the rear 18 and sloping downwardly at the rear to form an enclosed back wall 20. The shelter is formed by a combination of a supporting structure 22 and a flexible covering 24, such as a tarpaulin or cloth sheet. The open front 12 is enclosed by a curtain 26 made of the same or similar material. The parts of the flexible covering may be joined, for example, by a zipper 28.

The supporting structure 22 as seen most clearly in FIG. 2, includes a plurality of roof rafters 30, 32 34 and 36. Looking at the shelter from its front end, the left and right end rafters 30 and 36 are supported by identical uprights 38 at their front ends and similarly formed, but shorter uprights 40 at their rear end so as to slope from the front toward the rear. One or more intermediate upright members 42 may be provided. Axially connected to the rear end of each rafter are bow members 44, 46, 48 and 50. The bow members are reduced in outer diameter at their inner ends so as to telescoping fit into the rear end of each of the corresponding roof rafters 30, 32, 34 and 36. At their free or lower ends, each of the bow members 44, 46, 48 and 50 are provided with a intergrally formed disk like footing member 52 adapted to squarely rest on the ground 54 on which the shelter is to be built. Similarly, the upright members 38, 40 and 42 are similarly provided each with a footing members 2. At the forward end 12 or open end of the shelter, the roof rafters are connected by a ridge bar 56 and a door bar 58 which provides structural support for the opening 12 as well as for the uprights 38. The roof rafters are further joined and held in fixed position by several cross bar 60 located intermediate between the front and rear ends 12 and 18 as well as at its rear most end of the roof 18, respectively. The bow members 44 through 50 are connected by a cross bar 62 located at their bottom end just above the base plate 52.

Extending at an angle from the intersection of the door ridge 58 and the uprights 38, is a bracing member 64 which is also provided with a base plate 52. The cross bars 60 are joined to the end rafters 30 and 36 only, by brackets 66 to be described later. They may be joined to the interior rafters if desired.

Figure 3:
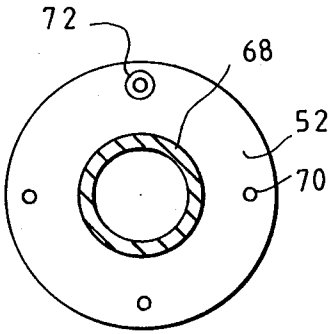
FIG. 3 is a plan view of a base plate used in the assembly of the bar elements.

The base plate 52 is is illustrated in FIG. 3 and preferably made of heavy gauge iron or steel. It is circular in shape with the central post 68 for reception into the end of the upright bars and of the bow members so as to be swedged, welded or bolted unitarily together. The base plate 52 is provided with the plurality of openings 70, spaced about its circumferential edge for the reception of nails, stakes or anchor pins 72, by which the entire shelter frame assembly is secured to the ground 54.

The bracket 66 is illustrated in detail in FIG. 4 as joining together a rafter 30 (36) and an upright support member 38 (40,42). Their use to join other supporting elements will be obvious.

The fastening bracket 66 comprises a pair of semi-cylindrical substantially mirror image members 74 and 76 which, when joined together, define a first circular hollow bore 78 extending longitudinally and a second shorter hollow bore 80 extending transversely and orthoganally to the first bore. Each of the first and second bores 78 and 80 are adapted to receive therein a rafter member 30 and a vertical post member 38 respectively.

In the illustration of FIG. 4, the longer bore 78 receives the terminal end of the corresponding vertical uprights 38. The interior of the half bracket members 74 and 76 are provided with an annular ridge 82 just inside its open end, and an annular stop member 84 spaced from the perpendicular shorter tube 80. Thus, each of the vertical posts can be inserted into their respective bracket to an exact position, determined by the stop 84, while at the same time, being subjected to a radial crimping force created by the ridge 82 as will be apparent shortly. The uprights can be formed with an annular recess 86 into which the ridge 82 can fit. In this manner, the height of each upright is defined relative to the rafter.

The two halves 74 and 76 of the elongated bracket 66 are forced together by a carriage bolt 88 passing through a hole 90, set diagonally relative to the long bore 78 and tightened by a nut 92. Tightening of the carriage bolt and nut by conventional wrench means will not only set the verical posts in position but it will cause the crimping of the upright. At the same time, it will also lock tightly the rafter inserted through the smaller bore 80. To insure proper displacement of the force of the carriage bolt 88 and nut 92, an arcuate plate 94 is provided beneath the head 96 of the carriage bolt which extends over a substantial portion of the upper bracket half 74. The bracket 66 may be easily removed from the rafter and vertical posts by unscrewing the carriage bolt and nut, thus loosening the bracket, permitting its removal.

This type of fitting can be used at each of the perpendicular intersections of tubing members where one of the tubing members ends and the other passes through in a perpendicular relationship, including the connection of each of the rafters to the door ridge bar 58.

Returning to FIG. 1, the connection between the bracing stay 64 and the vertical post 38 at the front end of the structure, is preferably made by use of a plate-like 98 bracket provided with a pair of holes fitting similarly formed holes in each of the stays 64 and post 38. The holes are set at the angle which would provide the necessary angle for the stay 64. The slate bracket 98 may be held by nuts and bolts passing through the respective holes. The connection between the vertical posts 38 at the door, and the ridge bar 56 may also be made by a three dimensional type fitting having three arms each extending into the ends of the respective post and rib members.

Thus, the inventive shelter frame construction is made stable as well as being made from strong, lightweight materials which are easy to transport, assemble and disassemble as desired.

Various changes and modifications have been discussed, and others will be apparant to those skilled in the art. Accordingly, it is intended that the present invention be taken as illustative rather than restrictive of the scope of the present invention.

What is claimed is:

1. A portable shelter frame structure comprising a roof including a plurality of parallelly disposed longitudinally extending rafter bars, each having at one end connected thereto a bow member, said rafter bars being connected at their other ends to a common ridge bar supported above ground level by a pair of spaced upright bars connected thereto at the lateral ends of said ridge bar, a door bar connecting the upright bars to each other, said upright bars and the ends of said bow members being set in base plates adapted to rest on the ground, and a removable sheet covering shaped to fit over said frame structure, secured to said rafter bars and depending therefrom.

2. A portable shelter frame structure according to claim 1, including a bottom cross bar connected to the bottom of the bow members.

3. A portable shelter frame structure according to claim 1, including a top cross bar connecting the rafter bars to each other at a point between the ridge bar and the bow members.

4. A portable shelter frame structure according to claim 1, including a mid cross bar connecting the rafter bars to each other near the top of the bow members.

5. A portable shelter frame structure according to claim 1, including a pair of rear upright bars supporting the rafter bars in the vicinity of the bow members.

6. A portable shelter frame according to claim 1 including a pair of upright braces supporting the upright bars.

7. A portable shelter frame structure according to claim 1, wherein the covering is formed of tarpaulin sections provided with cooperating zipper shaped to fit over the frame when joined together.

8. A portable shelter frame structure according to claim 1, wherein the covering includes a door member.

9. The portable shelter frame structure according to claim 1 wherein said bow members are telescopingly secured to the ends of said rafter bars and are separable therefrom.

10. The portable shelter frame structure according to claim 1, including a bracket for removably joining the connected bar members, comprising a pair of semicylindrical substantially mirror image members which, when joined together, define a first circular hollow bore extending longitudinally and a second shorter hollow bore extending orthoganally to said first bore, each of the first and second bores being adapted to receive therein a rafter bar and one of said ridge and upright bars, respectively, the interior of the mirror image members being provided with an annular ridge just inside the open end of the longitudinal bore and an annular stop member spaced from the transverse shorter bore to rest the insertion of the bar into said longitudinal bore, means for compressively securing said mirror image members together which simultaneously cause said mirror annular ridge to engage and secure the bar within said longitudinal bore.

11. The portable shelter frame structure according to claim 10 wherein said means for compressively securing said mirror image members together comprise a carriage bolt, passing diametrically through said mirror image members between said annular ridge and said orthoganal short bore.

* * * * *